US006248489B1

(12) United States Patent
Yagi et al.

(10) Patent No.: US 6,248,489 B1
(45) Date of Patent: Jun. 19, 2001

(54) ELECTROPHOTOGRAPHIC PHOTOSENSITIVE BODY, INTERMEDIATE TRANSFER MEDIUM, AND ELECTROPHOTOGRAPHIC APPARATUS

(75) Inventors: Hitoshi Yagi, Yokohama; Mitsunaga Saito, Ichikawa; Koichi Ishii, Kawasaki; Sadao Kajiura, Naka-gun; Yuka Yamaguchi, Kawasaki; Mitsuhiko Iida, Tokyo, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/471,496

(22) Filed: Dec. 23, 1999

(30) Foreign Application Priority Data

Dec. 28, 1998 (JP) ..... 10-372384
Nov. 22, 1999 (JP) ..... 11-331971

(51) Int. Cl.[7] ..... G03G 5/14

(52) U.S. Cl. ..... 430/66; 430/67; 399/302; 428/694

(58) Field of Search ..... 430/96, 84, 66, 430/67; 428/694 BF; 399/302

(56) References Cited

U.S. PATENT DOCUMENTS 4,581,315 * 4/1986 Garito ..... 430/269
4,600,673 7/1986 Hendrickson et al. ..... 430/66
5,064,696 11/1991 Takahashi et al. ..... 427/430.1
5,652,078 7/1997 Jalbert et al. ..... 430/67
5,858,541 * 1/1999 Hiraoka et al. ..... 428/429
5,885,654 * 3/1999 Hagiwara et al. ..... 427/226

FOREIGN PATENT DOCUMENTS 11-249330 9/1999 (JP) .

OTHER PUBLICATIONS

L.J. Bresina, et al., "Process Control in Liquid Electrophotography for Critical Color Halftone Digital Proofing", IS&T's Eighth International Congress on Advances in Non–Impact Printing Technologies, 1992, pp. 215–218.

* cited by examiner

*Primary Examiner*—John Goodrow
(74) *Attorney, Agent, or Firm*—Oblon, Spivak, McClelland, Maier & Neustadt, P.C.

(57) ABSTRACT

This invention provides an electrophotographic photosensitive body including a photosensitive layer containing a chemical substance selected from a compound having a polysilazane skeleton, a compound having an Si—$C_nH_{2n+1}$ bond and one of an Si—N bond and an Si—C—N bond, a compound having an Si—$C_nF_{2n+1}$ bond and one of an Si—N bond and an Si—C—N bond, and a mixture of a compound having one of an Si—N bond and an Si—C—N bond and a compound having a C—F bond, an intermediate transfer medium including a surface layer containing the chemical substance, and an electrophotographic apparatus using the same.

20 Claims, 2 Drawing Sheets

ELECTROPHOTOGRAPHIC PHOTOSENSITIVE BODY, INTERMEDIATE TRANSFER MEDIUM, AND ELECTROPHOTOGRAPHIC APPARATUS

BACKGROUND OF THE INVENTION

The present invention relates to an electrophotographic photosensitive body, an intermediate transfer medium, and an electrophotographic apparatus.

In wet electrophotographic technology, a liquid developing agent formed by dispersing toner in a petroleum solvent is used, and the developing process uses the electrophoresis of toner particles in this petroleum solvent. This wet electrophotographic technology has various advantages that are unrealizable by dry electrophotographic technology. So, the merits of wet electrophotographic technology are being reconsidered recently.

For example, wet electrophotographic technology can realize high image quality because it can use very fine toner particles on submicron order. Also, since satisfactory image density can be obtained with a small amount of toner, this technology is economical and can achieve texture comparable with printing. Furthermore, energy saving is possible because toner can be fixed to a paper sheet at relatively low temperatures.

In electrophotographic technology, transfer efficiency has very large influence on image quality. For example, if a transfer efficiency of 100% is not achieved, i.e., if toner is not entirely transferred onto a paper sheet, the image density lowers, or the image quality lowers in the form of an image blur or the like. Accordingly, it is being desired to realize sufficiently high transfer efficiency, i.e., transfer efficiency close to 100%.

In wet electrophotographic technology, however, toner is fine and a developing agent contains a solvent, so the adhesion of the toner to a photosensitive body is excessively strong. Therefore, satisfactory transfer efficiency is not always obtained in the conventional wet electrophotographic technology.

For example, U.S. Pat. Nos. 5,148,222, 5,166,734, and 5,208,637 have disclosed an electric field transfer method by which toner is transferred from a photosensitive body to a transfer roller by using electric field, and this toner on the transfer roller is then transferred onto a paper sheet by using pressure or the like. In this method, the movement of toner particles from the photosensitive body to the transfer roller is primarily brought about by the electrophoresis of the toner particles in a liquid developing agent interposed between the photosensitive body and the transfer roller. Hence, if the adhesion of the toner to the photosensitive body is excessively strong, an extremely large potential difference must be produced between the photosensitive body and the transfer roller. Unfortunately, no such large potential difference is normally applied. So, sufficiently high transfer efficiency is difficult to achieve when this electric field transfer method is employed.

Jpn. Pat. Appln. KOKOKU Publication No. 46-41679 and Jpn. Pat. Appln. KOKAI Publication No. 62-280882 have disclosed a so-called offset transfer method which transfers toner from a photosensitive body to a transfer roller and from the transfer roller onto a paper sheet by using heat or pressure. This offset transfer method can realize higher transfer efficiency than in the electric field transfer method. However, even this offset transfer method hardly achieves transfer efficiency close to 100%.

As described above, in the wet electrophotographic technology it is very difficult to realize transfer efficiency close to 100% only by improving the transfer method. To improve the transfer efficiency, therefore, a method is proposed by which the surface of a photosensitive body is coated with silicone resin or fluororesin to decrease the adhesion between the photosensitive body surface and toner.

This method can actually improve the transfer efficiency. However, this effect is obtained only in the initial stages. That is, even when a thin film is formed on the surface of a photosensitive body by using silicone resin or fluororesin, high transfer efficiency cannot be maintained for long time periods. The reasons will be described below.

A thin film formed on the surface of a photosensitive body has influences on the electrostatic property of the photosensitive body and on the electrostatic interaction between the photosensitive body and toner. Therefore, to obtain high image quality, this thin film must be formed to be very thin. Unfortunately, a thin film formed by using silicone resin or fluorine resin has low mechanical strength. Hence, when transfer steps are repeated, the surface of this thin film wears and the transfer efficiency gradually lowers.

Additionally, toner remaining on the photosensitive body surface without being transferred onto a paper sheet must be removed by a cleaner. If, however, it is obvious that the transfer efficiency lowers, a stronger cleaner must be used. Since the photosensitive body surface is more or less damaged by a cleaner, this damage to the photosensitive body surface increases if a stronger cleaner is used.

For these reasons, when a thin film is formed on the surface of a photosensitive body by using silicone resin or fluorine resin, the wear of this thin film progresses very rapidly. So, no high transfer efficiency can be maintained for long time periods. Therefore, a thin film formed on the photosensitive body surface is being desired to be able to well decrease the adhesion of toner to the photosensitive body surface and have satisfactory mechanical strength.

Note that the aforementioned problems are described primarily in relation to wet electrophotographic technology. However, such problems are similarly encountered in dry electrophotographic technology, as well as in wet electrophotographic technology.

BRIEF SUMMARY OF THE INVENTION

As described above, a thin film formed by using silicone resin or fluorine resin has low mechanical strength. Accordingly, no prior art can maintain high transfer efficiency for long periods of time.

The present invention has been made in consideration of the above situation, and has as its object to provide an electrophotographic photosensitive body and an intermediate transfer medium each of which has a surface with high mechanical strength, and an electrophotographic apparatus using at least one of them.

It is another object of the present invention to provide an electrophotographic photosensitive body and an intermediate transfer medium, each of which capable of maintaining high transfer efficiency for long time periods, and an electrophotographic apparatus using at least one of them.

The present inventors made extensive studies to solve the abovementioned problems and have found that when a thin film is formed on the surface of an electrophotographic photosensitive body or of an intermediate transfer medium by using polysilazane, it is possible to obtain a surface with high mechanical strength and prevent a large decrease of the transfer efficiency even after a long-term use.

On the basis of this finding, the present inventors examined thin films containing compounds having an Si—N bond. Consequently, the present inventors have found that very high transfer efficiency can be maintained for long time periods by the use of a thin film containing, of these compounds, a compound having an Si—$C_nH_{2n+1}$ bond or an Si—$C_nF_{2n+1}$ bond or a mixture of a compound having an Si—N bond and a compound having a C—F bond.

Furthermore, the present inventors examined thin films containing not only compounds having an Si—N bond but also compounds having an Si—C—N bond. Consequently, the present inventors have found that very high transfer efficiency can be maintained for long time periods, and the electrical resistance on the surface of an electrophotographic photosensitive body can be increased and hence high image quality can be realized, by the use of a thin film containing, of these compounds, a compound having an Si—$C_nH_{2n+1}$ bond or an Si—$C_nF_{2n+1}$ bond or a mixture of a compound having an Si—C—N bond and a compound having a C—F bond.

That is, according to the first aspect of the present invention, there is provided an electrophotographic photosensitive body comprising a substrate having a conductive surface, and a photosensitive layer formed on the conductive surface of the substrate to change a charged state upon irradiation with light and containing a compound having a polysilazane skeleton.

According to the second aspect of the present invention, there is provided an electrophotographic photosensitive body comprising a substrate having a conductive surface, and a photosensitive layer formed on the conductive surface of the substrate to change a charged state upon irradiation with light and containing a chemical substance selected from the group consisting of a compound having an Si—$C_nH_{2n+1}$ bond and one of an Si—N bond and an Si—C—N bond, a compound having an Si—$C_nF_{2n+1}$ bond and one of an Si—N bond and an Si—C—N bond, and a mixture of a compound having at least one of an Si—N bond and an Si—C—N bond and a compound having a C—F bond.

According to the third aspect of the present invention, there is provided an intermediate transfer medium mediating transfer of a developing agent image, formed on a photosensitive layer of an electrophotographic photosensitive body, onto a transfer material, comprising an underlying layer, and a surface layer formed on the underlying layer and containing a compound having a polysilazane skeleton.

According to the fourth aspect of the present invention, there is provided an electrophotographic apparatus comprising an electrophotographic photosensitive body comprising a substrate having a conductive surface, and a photosensitive layer formed on the conductive surface of the substrate to form an image holding surface and change a charged state upon irradiation of light, the photosensitive layer containing a compound having a polysilazane skeleton; latent image forming unit forming a latent image on the image holding surface; developing unit forming a developing agent image on the image holding surface on which the latent image is formed; and transfer unit transferring the developing agent image from the image holding surface onto a transfer material.

According to the fifth aspect of the present invention, there is provided an electrophotographic apparatus comprising an electrophotographic photosensitive body comprising a substrate having a conductive surface and a photosensitive layer formed on the conductive surface of the substrate to form an image holding surface and change a charged state upon irradiation of light, the photosensitive layer containing a chemical substance selected from the group consisting of a compound having an Si—$C_nH_{2n+1}$ bond and one of an Si—N bond and an Si—C—N bond, a compound having an Si—$C_nF_{2n+1}$ bond and one of an Si—N bond and an Si—C—N bond, and a mixture of a compound having at least one of an Si—N bond and an Si—C—N bond and a compound having a C—F bond; latent image forming unit forming a latent image on the image holding surface; developing unit forming a developing agent image on the image holding surface on which the latent image is formed; and transfer unit transferring the developing agent image from the image holding surface onto a transfer material.

According to the sixth aspect of the present invention, there is provided an electrophotographic apparatus comprising an electrophotographic photosensitive body having an image holding surface, latent image forming unit forming a latent image on the image holding surface, developing unit forming a developing agent image on the image holding surface on which the latent image is formed, and transfer unit transferring the developing agent image from the image holding surface onto a transfer material and comprising an intermediate transfer medium interposed between the electrophotographic photosensitive body and the transfer material to mediate transfer of the developing agent image, formed on the image holding surface, onto the transfer material, the intermediate transfer medium comprising, an underlying layer, and a surface layer formed on the underlying layer and containing a compound having a polysilazane skeleton.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The present invention will be described in more detail below with reference to the accompanying drawings.

Figure 1:
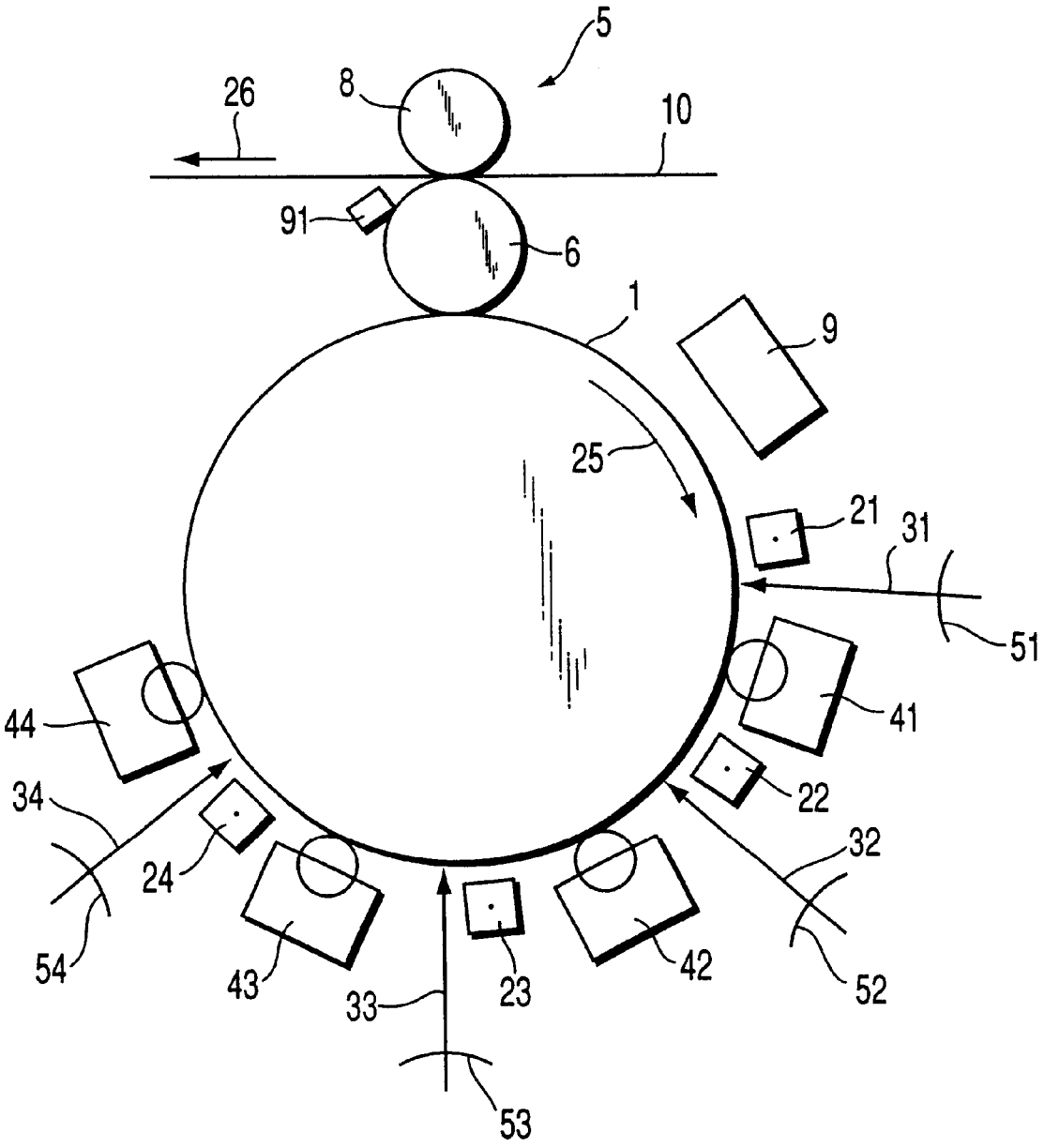
FIG. 1 is a view schematically showing an electrophotographic apparatus according to one embodiment of the present invention.

FIG. 1 is a view schematically showing an electrophotographic apparatus according to one embodiment of the present invention. This electrophotographic apparatus shown in FIG. 1 is a color electrophotographic apparatus for forming electrophotographic images by using yellow, magenta, cyan, and black liquid developing agents.

The electrophotographic apparatus shown in FIG. 1 has an electrophotographic photosensitive body 1 such as a photosensitive drum. Around this photosensitive body 1, a cleaner 9 for cleaning the surface of this photosensitive body 1, chargers 21 to 24 as charging device, developing devices 41 to 44, and a transfer unit 5 are arranged. Details of the individual components of the electrophotographic apparatus shown in FIG. 1 will be described below.

The photosensitive body 1 has a substrate having a conductive surface and a photosensitive layer formed on this conductive surface. This photosensitive layer forms an image holding surface and contains, e.g., an organic, amorphous silicon-, SeTe-, or zinc oxide-based photosensitive material which changes its charged state or the like upon irradiation with light. Also, this photosensitive layer can be charged either positively or negatively by the charger 2–n such as a corona charger, a corotron charger, or a scorotron charger.

As shown in FIG. 1, the photosensitive body 1 constructed as above is rotated in a direction indicated by an arrow 25 by a driving mechanism (not shown). Accordingly, the image holding surface of this photosensitive body 1 moves relative to the cleaner 9, the chargers 21 to 24, the developing devices 41 to 44, the transfer unit 5, and the like. The structure of the photosensitive body 1 will be described in detail later.

Around the photosensitive body 1, an optical unit having a light source such as a laser exposing device or LED (not shown) is placed as an image writing device. For example, output laser beams 31 to 34 from the laser exposing device pass through windows 51 to 54 constructing a part of the optical unit and irradiate the image holding surface of the photosensitive body 1 charged to a predetermined polarity by the chargers 21 to 24. Consequently, the difference is appeared between the surface potentials of an irradiated portion and an unirradiated portion, forming an electrostatic latent image corresponding to image information of yellow, magenta, cyan, and black on the image holding surface. Note that each of the latent image forming units is composed of this image writing device and the charging device described above.

Each of the developing devices 41 to 44 supplies a liquid developing agent, i.e., a developing solution, containing toner and a solvent, to the image holding surface of the photosensitive body 1 on which the electrostatic latent image is formed. Commonly, each of these developing devices 41 to 44 includes a vessel containing a developing agent, a developing roller slightly spaced apart from the image holding surface to supply the developing agent from the vessel to the image holding surface of the photosensitive body 1, and a voltage applying mechanism for applying a voltage to the developing roller.

These developing devices 41 to 44 form developing agent images in a pattern corresponding to an electrostatic latent image on the surface of the photosensitive body 1 by using the charged polarity of toner. Around the photosensitive body 1, these developing devices 41 to 44 and latent image forming units are alternately arranged. That is, the electrophotographic apparatus shown in FIG. 1 can sequentially form yellow, magenta, cyan, and black developing agent images on the image holding surface of the photosensitive body 1.

The transfer unit 5 is constructed of a transfer roller 6 as an intermediate transfer medium placed in contact with the photosensitive body 1 and a pressure roller 8 for applying pressure to the transfer roller 6. The transfer roller 6 can be applied with a predetermined voltage by a voltage applying device (not shown). Usually, the transfer roller 6 incorporates a heater (not shown), and a cleaner 9 is placed around the transfer roller 6. Details of the structure of this transfer roller 6 will be described later.

An electrophotographic image formation process using the electrophotographic apparatus shown in FIG. 1 will be described below. This electrophotographic image formation process using the electrophotographic apparatus shown in FIG. 1 is performed while, e.g., the photosensitive body 1 is continuously rotated in the direction of the arrow 25. First, in accordance with the rotation of the photosensitive body 1, the image holding surface cleaned by the cleaner 9 reaches the front of the charger 21, where the image holding surface is evenly charged either positively or negatively.

Next, the image holding surface charged by the charger 21 is fed to the front of the window 51 as the photosensitive body 1 rotates. The laser exposing device (not shown) irradiates the charged image holding surface with the laser beam 31 through the window 51 in accordance with yellow image information. As a consequence, the exposed portion of the image holding surface is discharged, and an electrostatic latent image corresponding to the yellow image information is formed on the image holding surface.

The image holding surface on which the yellow electrostatic latent image is formed is then fed to the developing device 41 with the rotation of the photosensitive body 1. A yellow developing agent containing yellow toner and a solvent is supplied to the image holding surface that has reached the developing device 41. A predetermined bias voltage having the same polarity as the charged polarity of the toner is applied to the developing roller. Accordingly, an electric field is formed in the developing agent supplied to the gap between the image holding surface and the developing roller, and the toner moves toward the photosensitive body 1 by electrophoresis. As a consequence, a yellow developing agent image is formed on the image holding surface of the photosensitive body 1.

The developing solution used herein contains 1 to 10 wt % of toner and a solvent. As toner particles, it is possible to use, e.g., particles formed by mixing an acrylic copolymer and a pigment. As a solvent, it is possible to use a high-resistivity solvent, such as ISOPAR or NORPAR, available from EXXON, or an insulating petroleum solvent.

After the yellow developing agent image is formed on the image holding surface, magenta, cyan, and black developing agent images are sequentially formed in the same manner as above. After that, a transfer step to be explained below is performed.

First, a paper sheet 10 as a transfer material is inserted between the transfer roller 6 and the pressure roller 8. This transfer roller 6 is previously heated to a relatively low temperature, e.g., about 40 to 60° C., by the heater (not shown). Next, the photosensitive body 1, the transfer roller 6, and the pressure roller 8 are rotated to bring the developing agent image formed on the image holding surface into contact with the surface of the transfer roller 6, and a load of e.g. 50 kg is imposed on the transfer roller 6 by the pressure roller 8. Consequently, the developing agent image is transferred onto the transfer roller 6 from the image holding surface of the photosensitive body 1. Alternatively, by applying a voltage having the opposite polarity to the charged polarity of the toner, the developing agent image may be transferred onto the transfer roller 6 from the image holding surface of the photosensitive body 1.

The developing agent image transferred onto the transfer roller 6 moves with the rotation of the transfer roller 6 and comes in contact with the paper sheet 10. Since the pressure roller 8 applies pressure to the transfer roller 6, the developing agent image is transferred from the surface of the transfer roller 6 onto the paper sheet 10. The paper sheet 10 moves in a direction indicated by an arrow 26 as the transfer roller 6 rotates, so the developing agent image on the transfer roller 6 is continuously transferred onto the paper sheet 10. In wet electrophotographic technology, the fixing process is usually executable at room temperature. However, fixation can also be performed with heat, by heating the pressure roller 8 when the developing agent image is transferred to the paper sheet 10. In the way as described above, a full-color electrophotographic image can be formed on the paper sheet 10.

In this embodiment, at least one of the photosensitive body 1 and the transfer roller 6 of the aforementioned electrophotographic apparatus contains a compound containing Si, to be described in detail later, in the surface region. The structures of the photosensitive body 1 and the transfer roller 6 and this Si-containing compound will be described below.

First, structures employed when the surface region of the photosensitive body 1 contains the Si-containing compound will be described below with reference to FIGS. 2A and 2B.

Figure 2A:
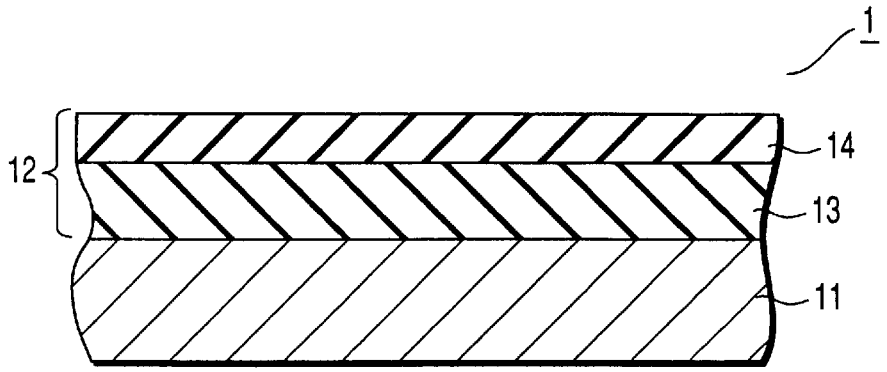
FIGS. 2A and 2B are sectional views showing photosensitive bodies used in the electrophotographic apparatus according to the embodiment of the present invention.
Figure 2B:
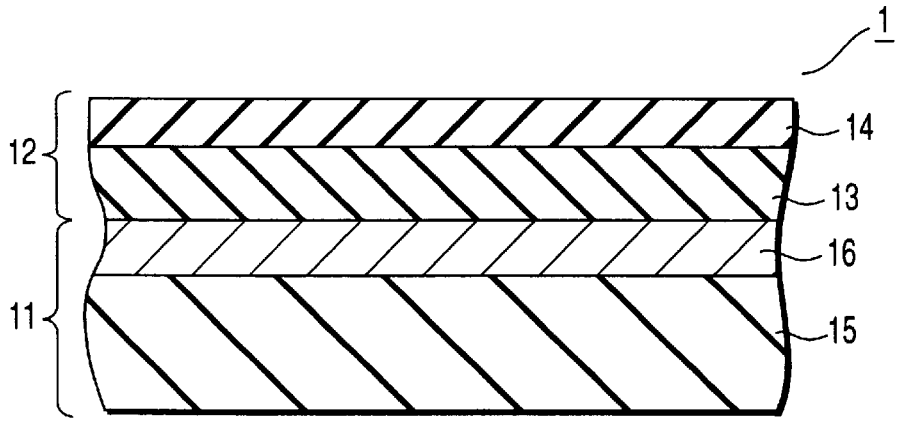

FIGS. 2A and 2B are sectional views showing examples of the photosensitive body 1 used in the electrophotographic apparatus according to the embodiment of the present invention. This photosensitive body 1 shown in each of FIGS. 2A and 2B has a substrate 11 having a conductive surface and a photosensitive layer 12 formed on this conductive surface of the substrate 11.

As shown in FIG. 2A, the substrate 11 can be a conducive substrate 11 made of a conductive material such as Al. Alternatively, as shown in FIG. 2B, the substrate 11 can be constructed by forming a conductive film 16 on the surface of an insulating substrate 15 made of an insulator such as polyethylene.

The photosensitive layer 12 contains the Si-containing compound described above and an organic, amorphous silicon-, SeTe-, or zinc oxide-based photosensitive material. This photosensitive layer 12 can be charged either positively or negatively by the chargers 21 to 24. The photosensitive layer 12 can have a single-layer structure in which the Si-containing compound and the photosensitive material are mixed. However, as shown in FIGS. 2A and 2B, this photosensitive material usually has a structure in which a photoconductive layer 13 containing the photosensitive material and a surface layer 14 containing the Si-containing compound are stacked on the conductive surface of the substrate 11. When the photosensitive layer 12 has this stacked structure as shown in FIGS. 2A and 2B, contamination of the photoconductive layer 13 can be prevented. With this structure, it is also possible to prevent deterioration caused by contact of the photoconductive layer 13 with the solvent contained in the developing agent.

Next, a structure employed when the surface region of the transfer roller 6 contains the Si-containing compound will be described below with reference to FIG. 3.

Figure 3:
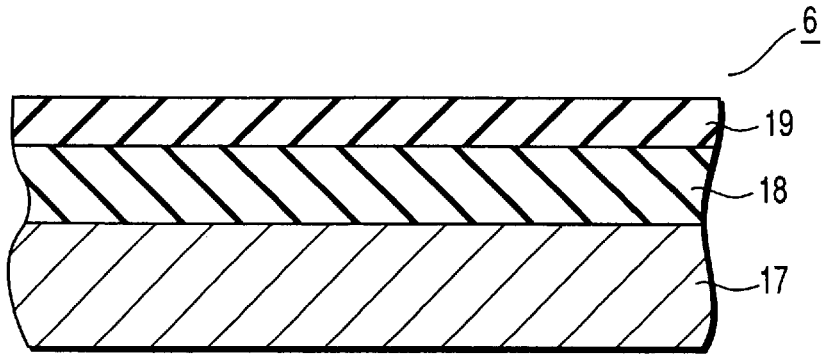
FIG. 3 is a sectional view showing a transfer roller used in the electrophotographic apparatus according to the embodiment of the present invention.

FIG. 3 is a sectional view showing an example of the transfer roller 6 used in the electrophotographic apparatus according to the embodiment of the present invention. This transfer roller 6 shown in FIG. 3 has a substrate 17, and an underlying layer 18 and a surface layer 19 stacked in this order on the substrate 17.

The substrate 17 of the transfer roller 6 is not an essential component; it is properly used in accordance with, e.g., the material of the underlying layer 18 or the construction of the apparatus. The material of this substrate 17 is not particularly limited. The underlying layer 18 can be formed into the shape of a tube by using materials generally used in a transfer roller, e.g., resins such as polyimide, polyester, Teflon, and polypropylene and flexible metals such as nickel and stainless steel. The underlying layer 18 can also be formed into a tube shape by using elastomers such as urethane rubber, silicone rubber, and NBR.

The surface layer 19 of the transfer roller 6 contains the Si-containing compound. When the transfer roller 6 has this surface layer 19, surface contamination can be prevented. It is also possible to prevent deterioration caused by contact of the underlying layer 18 with the solvent contained in the developing agent.

If the surface region of the photosensitive body 1 does not contain the Si-containing compound, a structure formed by removing the surface layer 14 from the photosensitive body 1 shown in FIG. 2A or 2B is used. Likewise, if the surface region of the transfer roller 6 does not contain the Si-containing compound, a structure formed by removing the surface layer 19 from the transfer roller 6 shown in FIG. 3 is used.

The surface layer 14 of the photosensitive body 1 and the surface layer 19 of the transfer roller 6 contain a compound, such as polysilazane, having an Si—N bond or an Si—C—N bond, as the Si-containing compound. This compound is usually contained in the surface layers 14 and 19 as an unreacted product of the material used in the formation of silica or as a reacted by-product formed upon the formation of silica. That is, the surface layers 14 and 19 commonly contain silica as a compound having an Si—O bond in addition to a compound having an Si—N bond or an Si—C—N bond.

A compound having an Si—N bond or an Si—C—N bond, contained in the surface layers 14 and 19, can be a low-molecular-weight compound having only one structure represented by formula (1) or (2) below. However, this compound is preferably a polymer whose main chain has the structure represented by formula (1) or (2) as a repetition unit, i.e., a compound having a polysilazane skeleton. The surface layers 14 and 19 formed using a polymer having this structure, i.e., the surface layers 14 and 19 containing a polymer having this structure have very high mechanical strength. Accordingly, a large reduction of the transfer efficiency can be prevented even after a long-term use.

(1)

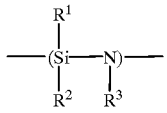

(2)

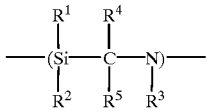

[In formulas (1) and (2) above, each of $R^1$, $R^2$, $R^3$, $R^4$, and $R^5$ is selected from the group consisting of a hydrogen atom, an alkyl group, an alkenyl group, a cycloalkyl group, an allyl group, an alkyl group in which at least one hydrogen atom is substituted with fluorine, an alkylsilyl group, and an alkylamino group. One of $R^1$ to $R^3$ is a hydrogen atom.]

A silazane skeleton generally means the structure represented by formula (1). In the present invention, however, a silazane skeleton also includes the structure represented by formula (2) which is a modified form of the structure represented by formula (1). That is, in the present invention a compound having a polysilazane skeleton includes a polymer having the structure represented by formula (1) as a repetition unit, a polymer having the structure represented by formula (2) as a repetition unit, and a polymer having the structures represented by formulas (1) and (2) as repetition units.

These polymers can be straight-chain or branched-chain polymers and can have a cyclic structure. Also, these polymers preferably have an Si—O bond or an Si—O—Si bond.

A compound having an Si—N or Si—C—N bond, contained in the surface layers 14 and 19, preferably has an Si—$C_nH_{2n+1}$ or Si—$C_nF_{2n+1}$ bond (n is a natural number). That is, an Si atom in this compound is preferably modified by a hydrocarbon group (—$C_nH_{2n+1}$ group) or fluorocarbon group (—$C_nF_{2n+1}$ group). When these functional groups are introduced into the compound, it is possible to obtain sufficiently high transfer efficiency, i.e., realize high image quality, since the adhesion between these surface layers 14 and 19 and toner can be reduced.

When these functional groups are introduced into the compound, another factor also contributes to the improvement of the image quality. As mentioned earlier, the electrostatic interaction is used in electrophotographic technology to form a developing agent image on the image holding surface of a photosensitive body. To obtain high image quality, therefore, the electrical resistance on this image holding surface must be sufficiently high. However, if the surface layers 14 and 19 adsorb atmospheric moisture, this electrical resistance on the image holding surface lowers. Consequently, an electrostatic latent image blurs, and this deteriorates the image quality.

In contrast, when an Si atom in a compound having an Si—N or Si—C—N bond, contained in the surface layers 14 and 19, is modified by a hydrocarbon group or fluorocarbon group, it is possible to prevent the adsorption of atmospheric moisture by the surface layers 14 and 19. Accordingly, the electrical resistance on the image holding surface can be kept sufficiently high even at high humidity, so high image quality can be realized.

In addition to a compound having an Si—N bond or an Si—C—N bond, the surface layers 14 and 19 preferably further contain a compound having a C—F bond, such as fluorine resin represented by polytetrafluoroethylene (to be referred to as PTFE hereinafter). This also makes it possible to reduce the adhesion between the surface layers 14 and 19 and toner and obtain sufficiently high transfer efficiency. Additionally, for the same reason as above, the electrical resistance on the image holding surface can be kept sufficiently high. Accordingly, higher image quality can be achieved. Note that a compound having a C—F bond is usually contained in the surface layers 14 and 19 in the form of fine particles having an average diameter of 0.01 to 0.4 μm.

The surface layers 14 and 19 can also contain other additives in addition to a compound having a C—F bond. Such additives can be either organic or inorganic compounds. Examples of organic compounds which the surface layers 14 and 19 can contain are polymers such as silicone resin, acrylic resin, urethane resin, polyimide resin, polyamide resin, polyvinylpyrrolidone, and polyvinyl alcohol; and dyes and pigments such as phthalocyanine, quinacridone, and an azo dye. Examples of inorganic compounds which the layers 14 and 19 can contain are metal oxides such as tin oxide, antimony oxide, indium oxide, titanium oxide, silica, magnesium oxide, manganese oxide, and vanadium oxide; metal nitrides; silicon carbide; metal sulfides such as molybdenum disulfide; minerals having a composite crystal structure, such as talc, mica, kaolin, and montmorillonite; powders of metals such as copper, aluminum, and nickel; and dyes and pigments such as carbon.

These additives can be contained in the surface layers 14 and 19 in the form of fine particles having an average particle size of about 0.01 to 5 μm. If possible, these additives are contained as they chemically bond to a compound having an Si—N bond or an Si—C—N bond. The concentration of these additives in the surface layers 14 and 19 is preferably 50 wt % or less, and more preferably, 20 wt % or less. Commonly, satisfactory mechanical strength can be obtained if the additive concentration in the surface layers 14 and 19 is within the above range.

A compound having an Si—N or Si—C—N bond, contained in the surface layers 14 and 19, can have either an Si—N bond or an Si—C—N bond, but preferably has an Si—C—N bond. When the surface layers 14 and 19 contain a compound having an Si—C—N bond, the electrical resistance on the image holding surface of the photosensitive body 1 can be increased more compared with the case that these surface layers 14 and 19 contain a compound having an Si—N bond. Accordingly, higher image quality can be realized.

The surface layers 14 and 19 have a thickness of preferably about 0.05 to 2 μm, and more preferably, about 0.1 to 1 μm. If the surface layers 14 and 19 are excessively thick, cracks are readily formed. Additionally, the electrostatic interaction between the photoconductive layer 13 and toner may be weakened to deteriorate the image quality. If the surface layers 14 and 19 are excessively thin, it is sometimes impossible to obtain satisfactory mechanical strength.

As will be described later, the surface layers 14 and 19 according to this embodiment are formed by coating of a predetermined coating solution. Therefore, the film thickness of these layers is far larger than that of a nitride film formed by nitriding bulk silicon or that of a native oxide film formed on the surface of bulk silicon. In other words, the above effect cannot be obtained only by simply nitriding the surface region of bulk silicon.

These surface layers 14 and 19 can be formed by, e.g., the following method. The formation of the surface layers 14 and 19 using polysilazane having the structure represented by formula (1) as a repetition unit will be explained below as an example.

First, the surface of the photoconductive layer 13 or underlying layer 18 is coated with a coating solution, prepared by dissolving polysilazane in a predetermined solvent, by any of dipping, spin coating, roll coating, or spray coating. Next, the solvent is removed from the coating solution on the surface of the photoconductive layer 13 or underlying layer 18. Additionally, a compound having an OH group such as water or alcohol is used to cause hydrolysis, and the resultant product is condensed. In this condensation reaction, it is effective to heat the product. However, considering the heat resistant property of the photoconductive layer 13 or the underlying layer 18, it is impossible to heat the product at sufficiently high temperature in most cases. In this manner, polysilazane is converted into silica to obtain the surface layers 14 and 19.

When the surface layers 14 and 19 are formed using polysilazane by the above method, this polysilazane is not entirely converted into silica; a portion of the polysilazane is contained, as it is kept unreacted or is partially reacted, in the surface layers 14 and 19. That is, when the surface layers 14 and 19 are formed using polysilazane, these surface layers 14 and 19 necessarily contain a compound having a polysilazane skeleton. More specifically, the surface layers 14 and 19 contain not only Si and O but also N and C.

When polysilazane is used, the surface layers 14 and 19 can be formed extremely densely. Therefore, satisfactory wear resistance can be obtained even if these surface layers 14 and 19 are made thin.

When the surface layers 14 and 19 are formed by the above method, it is desirable to use polysilazane, as the material, having a molecular weight $M_w$ of about 200 to 20,000.

When the surface layers 14 and 19 are formed by the above method, a coating solution containing polysilazane can contain the additives described above. This coating solution can also contain a compound which reacts with polysilazane. For example, the coating solution can contain silicones such as silicone oligomer, fluorine compounds such as tetrafluoroethylene, acryls, urethanes, polyimides, and polyamides. When a reaction such as copolymerization is to be brought about by using these compounds and polysilazane, the coating solution can further contain well-known coupling agents such as a silane coupling agent, titanate-based coupling agent, and zirconium-based coupling agent.

Although the above embodiment uses the transfer roller 6, this transfer roller 6 is not necessarily required. Also, in the above embodiment, transfer is performed after developing agent images of four colors are formed on the image holding surface. However, it is also possible to transfer developing agent images in units of colors.

Furthermore, in the above embodiment, wet electrophotographic technology to which the present invention is more effectively applicable is explained. However, the present invention is also applicable to dry electrophotographic technology. When the present invention is to be applied to dry electrophotographic technology, instead of a developing solution, toner prepared by forming a mixture of polyester resin and pigments, wax, and CCA into the form of particles is used as a developing agent. Also, a developing agent image can be formed on the image forming surface by frictionally charging this toner by a developing device, supplying the charged toner to the image holding surface, and applying a development bias voltage.

Examples of the present invention will be described below.

EXAMPLE 1

First, as a coating solution, a dibutylether solution containing 15 wt % of the perhydropolysilazane L120 manufactured by TONEN was prepared. The image holding surface of an amorphous silicon photosensitive body manufactured by KYOCERA was coated with this coating solution by dipping. After that, the coating solution on the image holding surface of this photosensitive body was preheated in an atmospheric-pressure ambient at 150° C. for 1 hr, and was further heated in a 90° C.·85 % RH ambient for 3 hrs. In this manner, a photosensitive body 1 having a surface layer 14 was manufactured. The film thickness of the surface layer 14 thus formed was 0.3 $\mu$m. Also, since the surface layer 14 was formed, the electrostatic characteristic of the photosensitive body 1 slightly deteriorated compared with that before the formation of the surface layer 14, but it still fell within a practical range.

Next, an underlying layer 18 having a 2-mm thickness and made of conductive silicone rubber was formed on the surface of a cylindrical rigid body substrate 17. The surface of this underlying layer 18 was coated with the aforementioned coating solution by dipping. After that, the coating solution on the conductive silicone rubber layer 18 was preheated in an atmospheric-pressure ambient at 150° C. for 1 hr, and was further heated in a 90° C.·85% RH ambient for 3 hrs. In this way, a transfer roller 6 having a surface layer 19 was manufactured. The film thickness of the surface layer 19 thus formed was 0.4 $\mu$m.

The surface layers 14 and 19 formed as above were examined. Consequently, the existence of Si—N bonds was confirmed, and each layer contained a compound having a polysilazane skeleton. Also, each of these surface layers 14 and 19 contained Si, N, and O at an atomic ratio of 51:9:40.

The photosensitive body 1 and the transfer roller 6 manufactured by the above method were used in the electrophotographic apparatus shown in FIG. 1, and electrophotographic images were formed on paper sheets 10 by using the method explained in the above embodiment. Note that the surface temperature of the transfer roller 6 was 50° C., and the contact pressure between the transfer roller 6 and the pressure roller 8 was 10 kg/cm$^2$. Note also that the Isopar L available from EXXON was used as a solvent of a developing agent, and particles containing acrylic resin were used as toner.

As a consequence, in the electrophotographic apparatus according to this example, image quality equivalent to that in the initial stages could be obtained even after electrophotographic images were formed on 10,000 paper sheets 10. Also, at that point the film thicknesses of the surface layers 14 and 19 reduced only by about 10% from their respective initial film thicknesses. This indicates that these surface layers 14 and 19 had sufficiently high mechanical strength.

EXAMPLE 2

First, as a coating solution, a dibutylether solution having a solid concentration of 15 wt % and containing 80 wt % of the perhydropolysilazane L120 manufactured by TONEN and 20 wt % of PTFE particles, was prepared. A photosensitive body 1 and a transfer roller 6 were manufactured following the same procedures as in Example 1 except that this coating solution was used. The film thickness of a surface layer 14 was 0.4 $\mu$m, and that of a surface layer 19 was 0.5 $\mu$m.

The surface layers 14 and 19 formed as above were examined. Consequently, the existence of Si—N bonds was confirmed, and each layer contained a compound having a polysilazane skeleton. Also, each of these surface layers 14 and 19 contained Si, N, and O at an atomic ratio of 50:10:40. Since the surface layer 14 was formed, the electrostatic characteristic of the photosensitive body 1 slightly deteriorated compared with that before the formation of the surface layer 14, but it still fell within a practical range.

The photosensitive body 1 and the transfer roller 6 manufactured by the above methods were used in the electrophotographic apparatus shown in FIG. 1, and electrophotographic images were formed on paper sheets 10 by using the method explained in the above embodiment. Note that various conditions such as surface temperature of the transfer roller 6 were the same as in Example 1.

As a consequence, in the electrophotographic apparatus according to this example, image quality equivalent to that in the initial stages could be obtained even after electrophotographic images were formed on 20,000 paper sheets 10. Also, at that point the film thicknesses of the surface layers 14 and 19 reduced only by about 14% from their respective initial film thicknesses. This indicates that these surface layers 14 and 19 had sufficiently high mechanical strength.

EXAMPLE 3

First, a dibutylether solution containing 15 wt % of the perhydropolysilazane L120 manufactured by TONEN was prepared. Next, a solution containing this dibuthylether solution and a hydrolytic product of 3-3-3-trifluoropropyltrimethoxysilane at a weight ratio of 100:1 was prepared as a coating solution. A photosensitive body 1 and a transfer roller 6 were manufactured following the same procedures as in Example 1 except that this coating solution was used. The film thickness of a surface layer 14 was 0.3 μm, and that of a surface layer 19 was 0.4 μm.

The surface layers 14 and 19 formed as above were examined. Consequently, the existence of Si—N bonds was confirmed, and each layer contained a compound having a polysilazane skeleton. Also, each of these surface layers 14 and 19 contained Si, N, and O at an atomic ratio of 56:8:36. Since the surface layer 14 was formed, the electrostatic characteristic of the photosensitive body 1 slightly deteriorated compared with that before the formation of the surface layer 14, but it still fell within a practical range.

The photosensitive body 1 and the transfer roller 6 manufactured by the above method were used in the electrophotographic apparatus shown in FIG. 1, and electrophotographic images were formed on paper sheets 10 by using the method explained in the above embodiment. Note that various conditions such as the surface temperature of the transfer roller 6 were the same as in Example 1.

As a consequence, in the electrophotographic apparatus according to this example, image quality equivalent to that in the initial stages could be obtained even after electrophotographic images were formed on 20,000 paper sheets 10. Also, at that point the film thicknesses of the surface layers 14 and 19 reduced only by about 11% from their respective initial film thicknesses. This indicates that these surface layers 14 and 19 had sufficiently high mechanical strength.

EXAMPLE 4

First, a dibutylether solution containing 15 wt % of a perhydropolysilazane L120 manufactured by TONEN was prepared. Next, a solution containing this dibuthylether solution and the fluorine resin fine-particle RUBULONE L-2F manufactured by DAIKIN at a weight ratio of 10:1 was prepared as a coating solution. A photosensitive body 1 and a transfer roller 6 were manufactured following the same procedures as in Example 1 except that this coating solution was used. The film thickness of a surface layer 14 was 0.4 μm, and that of a surface layer 19 was 0.5 μm.

The surface layers 14 and 19 formed as above were examined. Consequently, the existence of Si—N bonds was confirmed, and each layer contained a compound having a polysilazane skeleton. Also, each of these surface layers 14 and 19 contained Si, N, and O at an atomic ratio of 49:10:41. Since the surface layer 14 was formed, the electrostatic characteristic of the photosensitive body 1 slightly deteriorated compared with that before the formation of the surface layer 14, but it still fell within a practical range.

The photosensitive body 1 and the transfer roller 6 manufactured by the above method were used in the electrophotographic apparatus shown in FIG. 1, and electrophotographic images were formed on paper sheets 10 by using the method explained in the above embodiment. Note that various conditions such as the surface temperature of the transfer roller 6 were the same as in Example 1.

As a consequence, in the electrophotographic apparatus according to this example, image quality equivalent to that in the initial stages could be obtained even after electrophotographic images were formed on 25,000 paper sheets 10. Also, at that point the film thicknesses of the surface layers 14 and 19 reduced only by about 14% from their respective initial film thicknesses. This indicates that these surface layers 14 and 19 had sufficiently high mechanical strength.

EXAMPLE 5

First, a dibutylether solution containing 15 wt % of a perhydropolysilazane L120 manufactured by TONEN was prepared. Next, a solution containing this dibuthylether solution and a fine talc powder having an average particle size of 0.2 μm at a weight ratio of 9:1 was prepared as a coating solution. A photosensitive body 1 and a transfer roller 6 were manufactured following the same procedures as in Example 1 except that this coating solution was used. The film thickness of a surface layer 14 was 0.7 μm, and that of a surface layer 19 was 0.9 μm.

The surface layers 14 and 19 formed as above were examined. Consequently, the existence of Si—N bonds was confirmed, and each layer contained a compound having a polysilazane skeleton. Also, each of these surface layers 14 and 19 contained Si, N, and O at an atomic ratio of 50:8:42. Since the surface layer 14 was formed, the charging characteristic of the photosensitive body 1 slightly deteriorated compared with that before the formation of the surface layer 14, but it still fell within a practical range.

The photosensitive body 1 and the transfer roller 6 manufactured by the above method were used in the electrophotographic apparatus shown in FIG. 1, and electrophotographic images were formed on paper sheets 10 by using the method explained in the above embodiment. Note that various conditions such as the surface temperature of the transfer roller 6 were the same as in Example 1.

As a consequence, in the electrophotographic apparatus according to this example, image quality equivalent to that in the initial stages could be obtained even after electrophotographic images were formed on 25,000 paper sheets 10. Also, at that point the film thicknesses of the surface layers 14 and 19 reduced only by about 14% from their respective initial film thicknesses. This indicates that these surface layers 14 and 19 had sufficiently high mechanical strength.

EXAMPLE 6

A photosensitive body 1 and a transfer roller 6 manufactured following the same procedures as in Example 1 were used in a one-component nonmagnetic contact type dry electrophotographic apparatus, and electrophotographic images were formed on paper sheets 10 by the normal dry process. The process rate was 80 mm/sec. As toner, positively charged black toner containing polyester was used. The charging potential of the photosensitive body 1 was 800V, and the potential of the photosensitive body 1 after exposure of laser light was 204V. The developing potential was 400V, and the potential of the transfer roller 6 was 850V. A heat-fixing process was performed at 160° C. for the paper sheets 10 on which developing agent images were transferred.

As a consequence, in the electrophotographic apparatus according to this example, image quality equivalent to that in the initial stages could be obtained even after electrophotographic images were formed on 10,000 paper sheets 10. Also, at that point the film thicknesses of the surface layers 14 and 19 reduced only by about 22% from their respective initial film thicknesses. This indicates that these surface layers 14 and 19 had sufficiently high mechanical strength.

EXAMPLE 7

The wet electrophotographic apparatus used in Example 1 was remodeled such that a paper sheet 10 passed between the photosensitive body 1 and the transfer roller 6 and a developing agent image was directly transferred from the photosensitive body 1 onto the paper sheet 10. Following the same procedures as in Example 1 except that developing agent images were directly transferred from the photosensitive body 10 onto paper sheets 10 by using this wet electrophotographic apparatus, electrophotographic images were formed on the paper sheets 10.

As a consequence, in the electrophotographic apparatus according to this example, image quality equivalent to that in the initial stages could be obtained even after printing was performed on 10,000 paper sheets 10. Also, at that point the film thicknesses of the surface layers 14 and 19 reduced only by about 23% from their respective initial film thicknesses. This indicates that these surface layers 14 and 19 had sufficiently high mechanical strength.

COMPARATIVE EXAMPLE 1

Formation of electrophotographic images was performed on paper sheets 10 following the same procedures as in Example 1 except that no surface layers 14 and 19 were formed. Consequently, no high-image-quality could be realized even in the initial stages.

COMPARATIVE EXAMPLE 2

A photosensitive body 1 and a transfer roller 6 were manufactured following the same procedures as in Example 1 except that surface layers 14 and 19 were formed using the silicone-based hard coating agent TOSGUARD 510 available from TOSHIBA SILICONE. The film thickness of the surface layer 14 was 1.2 $\mu$m, and that of the surface layer 19 was 2.1 $\mu$m.

The photosensitive body 1 and the transfer roller 6 manufactured by the above method were used in the electrophotographic apparatus shown in FIG. 1, and electrophotographic images were formed on paper sheets 10 by using the method explained in the above embodiment.

By using the electrophotographic apparatus according to this comparative example, electrophotographic images were formed on 10,000 paper sheets 10. As a consequence, image quality equivalent to that in the initial stages could be obtained only for the first 50 sheets. Also, since the surface layers 14 and 19 peeled at that point, their film thicknesses could not be measured.

COMPARATIVE EXAMPLE 3

Electrophotographic images were formed on paper sheets 10 following the same procedures as in Example 6 except that no surface layers 14 and 19 were formed. As a consequence, after electrophotographic images were formed on 5,000 paper sheets, background fog increased to make high image quality impossible to obtain. The present inventors investigated the cause and found that a photoconductive layer 13 and the like wore.

EXAMPLE 8

First, a photosensitive body 1 having the structure as shown in FIG. 2A was manufactured. A substrate 11 was a cylindrical conductive substrate. A photoconductive layer 13 was made from an organic photosensitive material formed by dispersing a phthalocyanine-based pigment in polycarbonate as a binder resin. A surface layer 14 was formed by the following method.

That is, the surface of the photoconductive layer 13 was cleaned with 2-propanol and dried by blowing high-pressure nitrogen gas. A coating solution was prepared by diluting perhydropolysilazane N-D820 available from TONEN with dibutylether such that the solid concentration was 10 wt %. After that, the photoconductive layer was coated with this coating solution in a nitrogen ambient by dipping. The pulling rate when the coating was performed by dipping was 10 cm/min.

The coating film formed on the photoconductive layer 13 was then air-dried in a room temperature ambient for 5 min. After that, prebaking at 60° C. was performed for 10 min to remove the organic solvent from the coating film. Furthermore, the coating film was hardened by heating under 60° C.·90% RH conditions for 5 hrs, thereby forming the surface layer 14. The film thickness of the surface layer 14 thus formed was about 0.20 $\mu$m.

The surface of the surface layer 14 formed as above was analyzed by using XPS (X-ray Photoelectron Spectroscopy). Consequently, the existence of Si—N bonds was confirmed, and the surface layer 14 contained a compound having a polysilazane skeleton and also contained Si, N, and O at an atomic ratio of 52:4:44.

The photosensitive body 1 manufactured by the above method was used in the electrophotographic apparatus shown in FIG. 1, and electrophotographic images were formed on paper sheets 10 by using the method explained in the aforementioned embodiment. The transfer efficiency was also measured. Note that an underlying layer 18 of a transfer roller 6 was formed by urethane rubber, and no surface layer 19 was formed. The heating temperature was 70° C. for both of the photosensitive body 1 and the transfer roller 6. The load applied from the transfer roller 6 to the photosensitive body 1 was controlled to 50 kg per width (approximately 210 mm) of an A4 paper sheet by using a pressure roller 8. The transfer efficiency was calculated by measuring the weights of each paper sheet 10 before and after transfer.

As a consequence, the electrophotographic apparatus according to this example had an initial transfer efficiency of 62% and had a transfer efficiency of 59% after electrophotographic images were formed on 10,000 paper sheets 10. That is, it was possible to prevent a large decrease of the transfer efficiency.

EXAMPLE 9

A photosensitive body 1 was manufactured following the same procedures as in Example 8 except that a surface layer 14 was formed by the following method. That is, a coating solution was prepared by diluting the F-D820 available from TONEN with dibutylether such that the solid concentration was 10 wt %. By using this coating solution, the surface layer 14 about 0.25 $\mu$m thick was formed following the same procedure as in Example 8. Note that the F-D820 of TONEN contains polysilazane modified by a fluorocarbon group.

The surface of the surface layer 14 formed as above was analyzed by using XPS. Consequently, the existence of Si—N bonds and Si—$C_nF_{2n+1}$ bonds was confirmed. A ratio $N_{SiN}/N_{SiCF}$ of the number $N_{SiN}$ of Si—N bonds to the number $N_{SiCF}$ of Si—$C_nF_{2n+1}$ bonds on the surface was 25/100. Also, the surface layer 14 contained a compound having a polysilazane skeleton and contained Si, N, O, and F at an atomic ratio of 35:5:30:30.

The photosensitive body 1 manufactured by the above method was used in the electrophotographic apparatus shown in FIG. 1, and electrophotographic images were formed under the same conditions as in Example 8. The transfer efficiency was also measured. As a consequence, in the electrophotographic apparatus according to this example, a transfer efficiency close to 100% could be obtained in the initial stages. Additionally, in the electrophotographic apparatus according to this example, a high transfer efficiency of 97% could be maintained even after electrophotographic images were formed on 10,000 paper sheets 10.

EXAMPLE 10

A photosensitive body 1 was manufactured following the same procedures as in Example 8 except that a surface layer 14 was formed by the following method. That is, a coating solution prepared by diluting the MSZ available from TONEN with dibutylether such that the solid concentration was 10 wt % was used. The surface layer 14 about 0.40 $\mu$m thick was formed following the same procedure as in Example 8 except the foregoing. Note that the MSZ of TONEN contains polysilazane modified by a hydrocarbon group.

The surface of the surface layer 14 formed as above was analyzed by using XPS. Consequently, the existence of Si—N bonds and Si—$C_nH_{2n+1}$ bonds was confirmed. A ratio $N_{SiN}/N_{SiCH}$ of the number $N_{SiN}$ of Si—N bonds to the number $N_{SiCH}$ of Si—$C_nH_{2n+1}$ bonds on the surface was 20/100. Also, the surface layer 14 contained a compound having a polysilazane skeleton and contained Si, C, N, and O at an atomic ratio of 35:29:6:30.

The photosensitive body 1 manufactured by the above method was used in the electrophotographic apparatus shown in FIG. 1, and electrophotographic images were formed under the same conditions as in Example 8. The transfer efficiency was also measured. As a consequence, in the electrophotographic apparatus according to this example, a transfer efficiency of 99% could be obtained in the initial stages. Additionally, in the electrophotographic apparatus according to this example, a high transfer efficiency of 96% could be maintained even after electrophotographic images were formed on 10,000 paper sheets 10.

EXAMPLE 11

A photosensitive body 1 was manufactured following the same procedures as in Example 8 except that a surface layer 14 was formed by the following method.

That is, the surface layer 14 about 0.35 $\mu$m thick was formed following the same procedure as in Example 8 except that a coating solution prepared by diluting the P-D820 available from TONEN with dibutylether such that the solid concentration was 15 wt % was used. Note that the P-D820 of TONEN contains polysilazane and PTFE particles having an average particle size of 20 nm.

The surface of the surface layer 14 formed as above was analyzed by using XPS. Consequently, the existence of Si—N bonds and C—F bonds was confirmed. A ratio $N_{SiN}/N_{CF}$ of the number $N_{SiN}$ of Si—N bonds to the number $N_{CF}$ of C—F bonds on the surface was 15/100. Also, the surface layer 14 contained a compound having a polysilazane skeleton and contained Si, C, N, O, and F at an atomic ratio of 25:20:4:18:33.

The photosensitive body 1 manufactured by the above method was used in the electrophotographic apparatus shown in FIG. 1, and electrophotographic images were formed under the same conditions as in Example 8. The transfer efficiency was also measured. As a consequence, in the electrophotographic apparatus according to this example, a transfer efficiency of 100% could be obtained in the initial stages. Additionally, in the electrophotographic apparatus according to this example, a high transfer efficiency of 94% could be maintained even after electrophotographic images were formed on 10,000 paper sheets 10.

COMPARATIVE EXAMPLE 4

A photosensitive body 1 was manufactured following the same procedures as in Example 8 except that a surface layer 14 was formed by the following method. That is, a coating solution was prepared by mixing 10 parts by weight of the TOSGUARD 510 (a silicone hard coating agent available from TOSHIBA SILICONE), 2 parts by weight of the XC98-B2472 (fluoroalkylsilane available from TOSHIBA SILICONE), and 5 parts by weight of 2-propanol. A photoconductive layer 13 was coated with this coating solution by dipping. The pulling rate when the coating was performed by dipping was 5 cm/min. The coating film formed on the photoconductive layer 13 was air-dried in a room-temperature atmospheric ambient for 5 min and hardened by heating at 90° C. for 1 hr, thereby forming the surface layer 14. The film thickness of the surface layer 14 thus formed was about 0.90 $\mu$m.

The surface of the surface layer 14 formed as above was analyzed by using XPS. Consequently, although the existence of Si—$C_nH_{2n+1}$ bonds and Si—$C_nF_{2n+1}$ bonds were confirmed, no Si—N bonds were found.

The photosensitive body 1 manufactured by the above method was used in the electrophotographic apparatus shown in FIG. 1, and electrophotographic images were formed under the same conditions as in Example 8. The transfer efficiency was also measured. As a consequence, in the electrophotographic apparatus according to this comparative example, a transfer efficiency of 100% could be obtained in the initial stages. However, in the electrophotographic apparatus according to this comparative example, the transfer efficiency significantly lowered only after electrophotographic images were formed on a few paper sheets 10, and lowered to 10% or less when electrophotographic images were formed on 50 paper sheets 10.

EXAMPLE 12

A photosensitive body 1 was manufactured following the same procedures as in Example 8 except that a surface layer 14 was formed by the following method.

That is, the surface of a photoconductive layer 13 was cleaned with 2-propanol and dried by blowing high-pressure nitrogen gas. After that, baking at 60° C. was performed for 10 min. Next, a coating solution was prepared by diluting the perhydropolysilazane N-D720 available from TONEN with dehydrated dibutylether such that the solid concentration was 20 wt %. After that, the photoconductive layer 13 was coated with this coating solution in a nitrogen ambient by dipping.

The pulling rate when the coating was performed by dipping was 10 cm/min. Note that the N-D720 of TONEN contains polysilazane having the structure represented by formula (2) presented earlier as a repetition unit.

Next, the coating film formed on the photoconductive layer 13 was hardened as it was left to stand in a room-temperature atmospheric ambient (25° C.·50% RH), thereby forming the surface layer 14. The film thickness of the surface layer 14 thus formed was about 0.25 μm.

The surface of the surface layer 14 formed as above was analyzed by using XPS. Consequently, the existence of Si—C—N bonds was confirmed. Also, the surface layer 14 contained a compound having a polysilazane skeleton and contained Si, C, N, and O at an atomic ratio of 35:32:3:30.

The photosensitive body 1 manufactured by the above method was used in the electrophotographic apparatus shown in FIG. 1, and electrophotographic images were formed under the same conditions as in Example 8. The transfer efficiency was also measured. As a consequence, the electrophotographic apparatus according to this example had an initial transfer efficiency of 62% and had a transfer efficiency of 59% after electrophotographic images were formed on 10,000 paper sheets 10. That is, it was possible to prevent a large decrease of the transfer efficiency.

Subsequently, the surface electrical resistance of the surface layer 14 was measured using a digital ultra high resistance/microcurrent meter (the R8340A manufactured by ADVANTEST) More specifically, a circular electrode having a circular opening 70 mm in diameter and a circular electrode 50 mm in diameter were concentrically placed on the surface layer 14. In this state, a voltage applied between these electrodes was changed among 500, 600, 700, 800, 900, and 1,000. The surface electrical resistance was measured for each of these voltages, and the average value was calculated. Consequently, the average value of the surface electrical resistances was $1.0\times10^{17}\Omega$ or more at a humidity of 40% RH and $1.0\times10^{15}\Omega$ or less at a humidity of 70% RH.

The above electrophotographic apparatus was used to form a 5×5 matrix of ϕ1-mm circular patterns at pitches of 2 mm on the surface layer 14. That is, a total of 25 visible circular images were formed. After that, these visible circular images were read by using a CCD camera. Furthermore, image processing software was used to obtain a total area S of the read visible circular images and calculate a ratio $S/S_0$ of this area S to a sum $S_0$ of the areas of these 25 ϕ1-mm circles, thereby evaluating image blur. As a consequence, the ratio $S/S_0$ at a humidity of 40% RH was found to be 1.06 and the ratio $S/S_0$ at a humidity of 70% RH was found to be 1.95.

EXAMPLE 13

A photosensitive body 1 was manufactured following the same procedures as in Example 12 except that a surface layer 14 was formed by the following method. That is, the surface layer 14 about 0.25 μm thick was formed following the same procedure as in Example 12 except that a coating solution was prepared by diluting the polysilazane F-D820 available from TONEN with dehydrated dibutylether such that the solid concentration was 10 wt %.

The surface of the surface layer 14 formed as above was analyzed by using XPS. Consequently, although the existence of Si—N bonds and Si—$C_nF_{2n+1}$ bonds was confirmed, no Si—C—N bonds were found. Also, the surface layer 14 contained a compound having a polysilazane skeleton and contained Si, C, N, O, and F at an atomic ratio of 30:18:3:24:25.

The photosensitive body 1 manufactured by the above method was used to measure the transfer efficiency in the same manner as explained in Example 12. As a consequence, the electrophotographic apparatus according to this example had an initial transfer efficiency of 100% and could maintain a high transfer efficiency of 98% even after electrophotographic images were formed on 10,000 paper sheets 10.

Subsequently, the surface electrical resistance of the surface layer 14 was measured in the same manner as explained in Example 12. Consequently, the average value of the surface electrical resistances at a humidity of 70% RH was $5.0\times10^{13}\Omega$. Image blur was also evaluated in the same way as explained in Example 12, and the ratio $S/S_0$ at a humidity of 70% RH was found to be 3.25.

EXAMPLE 14

A photosensitive body 1 was manufactured following the same procedures as in Example 12 except that a surface layer 14 was formed by the following method. That is, the surface layer 14 about 0.35 μm thick was formed following the same procedure as in Example 12 except that a coating solution was prepared by diluting the polysilazane F-D720 available from TONEN with dehydrated dibutylether such that the solid concentration was 10 wt %. Note that this F-D720 of TONEN has the structure represented by formula (2) as a repetition unit and contains polysilazane modified by a fluorocarbon group.

The surface of the surface layer 14 formed as above was analyzed by using XPS. Consequently, the existence of Si—C—N bonds and Si—$C_nF_{2n+1}$ bonds was confirmed. A ratio $N_{SiCN}/N_{SiCF}$ of the number $N_{SiCN}$ of Si—C—N bonds to the number $N_{SiCF}$ of Si—$C_nF_{2n+1}$ bonds on the surface was 25/100. Also, the surface layer 14 contained a compound having a polysilazane skeleton and contained Si, C, N, O, and F at an atomic ratio of 27:25:3:22:23.

The photosensitive body 1 manufactured by the above method was used to measure the transfer efficiency in the same manner as explained in Example 12. As a consequence, the electrophotographic apparatus according to this example had an initial transfer efficiency of 100% and could maintain a high transfer efficiency of 98% even after electrophotographic images were formed on 10,000 paper sheets 10.

Subsequently, the surface electrical resistance of the surface layer 14 was measured in the same manner as explained in Example 12. Consequently, the average value of the surface electrical resistances at a humidity of 70% RH was $2.0\times10^{17}\Omega$. Image blur was also evaluated in the same way as explained in Example 12, and the ratio $S/S_0$ at a humidity of 70% RH was found to be 1.04.

EXAMPLE 15

A photosensitive body 1 was manufactured following the same procedures as in Example 12 except that a surface layer 14 was formed by the following method. That is, a photoconductive layer 13 was coated with a coating solution following the same procedure as in Example 12 except that polysilazane formed by modifying the perhydropolysilazane N-D720 with a methyl group was used instead of the perhydropolysilazane N-D720. The coating film formed on the photoconductive layer 13 was air-dried in a room-temperature atmospheric ambient for 5 min. After that, baking was performed at 60° C. for 10 min to remove the organic solvent from the coating film. Additionally, the coating film was dipped in an aqueous hydrogen peroxide solution ($H_2O_2$ content: 35 wt %) for 30 sec to convert into silica. Immediately after this conversion, the coating film was washed with distilled water. Finally, the coating film was hardened by heating at 70° C. for 1 hr, thereby forming the surface layer 14 about 0.5 μm thick.

The surface of the surface layer 14 formed as above was analyzed by using XPS. Consequently, the existence of Si—C—N bonds and Si—$C_nH_{2n+1}$ bonds was confirmed. A ratio $N_{SiCN}/N_{SiCH}$ Of the number $N_{SiCN}$ of Si—C—N bonds to the number $N_{SiCH}$ of Si—$C_nH_{2n+1}$ bonds on the surface was 20/100. Also, the surface layer 14 contained a compound having a polysilazane skeleton and contained Si, C, N, and O at an atomic ratio of 31:38:3:28.

The photosensitive body 1 manufactured by the above method was used to measure the transfer efficiency in the same manner as explained in Example 12. As a consequence, the electrophotographic apparatus according to this example had an initial transfer efficiency of 98% and could maintain a high transfer efficiency of 95% even after electrophotographic images were formed on 10,000 paper sheets 10.

Subsequently, the surface electrical resistance of the surface layer 14 was measured in the same manner as explained in Example 12. Consequently, the average value of the surface electrical resistances at a humidity of 70% RH was $5.0\times10^{16}\Omega$. Image blur was also evaluated in the same way as explained in Example 12, and the ratio $S/S_0$ at a humidity of 70% RH was found to be 1.09.

EXAMPLE 16

A photosensitive body 1 was manufactured following the same procedures as in Example 12 except that a surface layer 14 was formed by the following method. That is, the surface layer 14 about 0.45 μm thick was formed following the same procedure as in Example 12 except that a coating solution prepared by diluting the polysilazane P-D720 available from TONEN with dehydrated dibutylether such that the solid concentration was 10 wt % was used. Note that the polysilazane P-D720 of TONEN contains polysilazane having the structure represented by formula (2) as a repetition unit and PTFE particles having an average particle size of 20 nm.

The surface of the surface layer 14 formed as above was analyzed by using XPS. Consequently, the existence of Si—C—N bonds and C—F bonds was confirmed. A ratio $N_{SiCN}/N_{CF}$ of the number $N_{SiCN}$ of Si—C—N bonds to the number $N_{CF}$ of C—F bonds on the surface was 15/100. Also, the surface layer 14 contained a compound having a polysilazane skeleton and contained Si, C, N, O, and F at an atomic ratio of 20:31:2:18:29.

The photosensitive body 1 manufactured by the above method was used to measure the transfer efficiency in the same manner as explained in Example 12. As a consequence, the electrophotographic apparatus according to this example had an initial transfer efficiency of 100% and could maintain a high transfer efficiency of 94% even after electrophotographic images were formed on 10,000 paper sheets 10.

Subsequently, the surface electrical resistance of the surface layer 14 was measured in the same manner as explained in Example 12. Consequently, the average value of the surface electrical resistances at a humidity of 70% RH was $3.0\times10^{16}\Omega$. Image blur was also evaluated in the same way as explained in Example 12, and the ratio $S/S_0$ at a humidity of 70% RH was found to be 1.11.

EXAMPLE 17

A photosensitive body 1 was manufactured following the same procedures as in Example 12 except that a surface layer 14 was formed by the following method. That is, the polysilazane formed by modifying the perhydropolysilazane N-D720 with a methyl group is diluted at first with dehydrated dibutylether to obtain a diluent having a solid concentration of 20 wt %. Subsequently, 2 wt % of amino-based silane coupling agents SH6020 manufactured by TORAY DOWCONING SILICONE was added to the diluent, thereby obtaining a coating solution.

The photoconductive layer was coated with this coating solution as in Example 12 and the coating film formed on the photoconductive layer 13 was then air-dried in a room temperature ambient for 5 min. After that, prebaking at 60° C. was performed for 10 min to remove the organic solvent from the coating film. Furthermore, the coating film was hardened by heating under 60° C.·90% RH conditions for 5 hrs, thereby forming the surface layer 14. The film thickness of the surface layer 14 thus formed was about 0.45 μm.

The surface of the surface layer 14 formed as above was analyzed by using XPS. Consequently, the existence of Si—C—N bonds and Si—$C_nH_{2n+1}$ bonds were confirmed. A ratio $N_{SiCN}/N_{SiCh}$ of the number $N_{SiCN}$ of Si—C—N bonds to the number $N_{SiCH}$ of Si—$C_nH_{2n+1}$ bonds on the surface was 20/100. Also, the surface layer 14 contained a compound having a polysilazane skeleton and contained Si, C, N, and O at an atomic ratio of 33:40:2:25.

The photosensitive body 1 manufactured by the above method was used to measure the transfer efficiency in the same manner as explained in Example 12. As a consequence, the electrophotographic apparatus according to this example had an initial transfer efficiency of 98% and could maintain a high transfer efficiency of 97% even after electrophotographic images were formed on 10,000 paper sheets 10.

Subsequently, the surface electrical resistance of the surface layer 14 was measured in the same manner as explained in Example 12. Consequently, the average value of the surface electrical resistances at a humidity of 70% RH was $2.0\times10^{16}\Omega$. Image blur was also evaluated in the same way as explained in Example 12, and the ratio $S/S_0$ at a humidity of 70% RH was found to be 1.15.

EXAMPLE 18

As a photosensitive body 1, a photosensitive body 1 was manufactured following the same procedures as in Example 12 except that the structure shown in FIG. 2B was used instead of the structure shown in FIG. 2A. As a substrate 11, an Al-deposited layer was formed as a conductive film 16 on a polyethylene insulating substrate 15. The photosensitive body 1 using a flexible material as the insulating substrate 15 is a so-called belt or sheet photosensitive body.

When the surface of this photosensitive body 1 was analyzed, the results were analogous to those in Example 12. Also, the photosensitive body 1 manufactured by the above method was used to measure the transfer efficiency in the same manner as explained in Example 12. The results were similar to those in Example 12. Furthermore, the surface electrical resistance of a surface layer 14 was measured and image blur was evaluated, and the results were identical to those in Example 12.

In the present invention, as has been described above, a thin film containing a predetermined compound which contains Si is formed on the surface of an electrophotographic photosensitive body or of an intermediate transfer medium. Accordingly, a surface having high mechanical strength can be obtained. That is, the present invention can prevent a large reduction of the transfer efficiency even after a long-term use.

Also, the present invention can maintain very high transfer efficiency for long time periods by using a compound having an Si—$C_nH_{2n+1}$ or Si—$C_nF_{2n+1}$ bond as the predetermined Si-containing compound, or by using a thin film containing a mixture of the predetermined Si-containing compound and a compound having a C—F bond.

Furthermore, the present invention can increase the electrical resistance of the surface of an electrophotographic photosensitive body and can thereby realize high image quality by using a compound having an Si—C—N bond as the predetermined Si-containing compound.

That is, the present invention provides an electrophotographic photosensitive body and an intermediate transfer medium each having a surface with high mechanical strength, and an electrophotographic apparatus using at least one of them.

The present invention also provides an electrophotographic photosensitive body and an intermediate transfer medium, each of which is capable of maintaining sufficiently high transfer efficiency for long time periods, and an electrophotographic apparatus using at least one of them.

The present invention further provides an electrophotographic photosensitive body and an intermediate transfer medium, each of which is capable of realizing high image quality, and an electrophotographic apparatus using at least one of them.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electrophotographic photosensitive body, comprising:

a substrate having a conductive surface;

a photoconductive layer formed on the conductive surface of the substrate and configured to change a charged state upon irradiation with light; and a surface layer formed on the photoconductive layer and containing a compound having a polysilazane skeleton.

2. A photosensitive body according to claim 1, wherein the compound having a polysilazane skeleton further has an Si—O bond.

3. An electrophotographic photosensitive body comprising:

a substrate having a conductive surface;

a photoconductive layer formed on the conductive surface of the substrate and configured to change a charged state upon irradiation with light; and a surface layer formed on the photoconductive layer and containing a chemical substance selected from the group consisting of:

a compound having an Si—$C_nH_{2n+1}$ bond and one of an Si—N bond and an Si—C—N bond;

a compound having an Si—$C_nF_{2n+1}$ bond and one of an Si—N bond and an Si—C—N bond; and a mixture of a compound having one of an Si—N bond and an Si—C—N bond and a compound having a C—F bond.

4. A photosensitive body according to claim 3, wherein the chemical substance is a polymer having an Si—F—N bond or an Si—C—N bond as a repetition unit in a main chain.

5. A photosensitive body according to claim 3, wherein the chemical substance further has an Si—O bond.

6. An intermediate transfer medium mediating transfer of a developing agent image, formed on a photosensitive layer of an electrophotographic photosensitive body, onto a transfer material, comprising:

an underlying layer; and a surface layer formed on the underlying layer and containing a compound having a polysilazane skeleton.

7. An intermediate transfer medium according to claim 6, wherein the compound having a polysilazane skeleton further has an Si—O bond.

8. An electrophotographic apparatus comprising:

an electrophotographic photosensitive body comprising a substrate having a conductive surface, a photoconductive layer formed on the conductive surface of the substrate to change a charged state upon irradiation of light, and a surface layer formed on the photoconductive layer and configured to form an image holding surface, the surface layer containing a compound having a polysilazane skeleton, latent image forming unit configured to form a latent image on the image holding surface;

developing unit configured to form a developing agent image on the image holding surface on which the latent image is formed; and transfer unit configured to transfer the developing agent image from the image holding surface onto a transfer material.

9. An apparatus according to claim 8, wherein the compound having a polysilazane skeleton further has an Si—O bond.

10. An apparatus according to claim 8, wherein the apparatus is a wet type electrophotographic apparatus.

11. An apparatus according to claim 8, wherein the apparatus is of a full color type.

12. An electrophotographic apparatus comprising:

an electrophotographic photosensitive body comprising a substrate having a conductive surface, a photoconductive layer formed on the conductive surface of the substrate to change a charged state upon irradiation of light, and a surface layer formed on the photoconductive layer and configured to form an image holding surface, the surface layer containing a chemical substance selected from the group consisting of:

a compound having an Si—$C_nH_{2n+1}$ bond and one of an Si—N bond and an Si—C—N bond;

a compound having an Si—$C_nF_{2n+1}$ bond and one of an Si—N bond and an Si—C—N bond; and a mixture of a compound having one of an Si—N bond and an Si—C—N bond and a compound having a C—F bond;

latent image forming unit configured to form a latent image on the image holding surface;

developing unit configured to form a developing agent image on the image holding surface on which the latent image is formed; and transfer unit configured to transfer the developing agent image from the image holding surface onto a transfer material.

13. An apparatus according to claim 12, wherein the chemical substance is a polymer having one of an Si—N bond and an Si—C—N bond as a repetition unit in a main chain.

14. An apparatus according to claim 12, wherein the chemical substance further has an Si—O bond.

15. An apparatus according to claim 12, wherein the apparatus is a wet type electrophotographic apparatus.

16. An apparatus according to claim 12, wherein the apparatus is of a full color type.

17. An electrophotographic apparatus comprising:

an electrophotographic photosensitive body having an image holding surface;

latent image forming unit configured to form a latent image on the image holding surface;

developing unit configured to form a developing agent image on the image holding surface on which the latent image is formed; and transfer unit configured to transfer the developing agent image from the image holding surface onto a transfer material and comprising an intermediate transfer medium, the intermediate transfer medium being interposed between the electrophotographic photosensitive body and the transfer material and configured to transfer the developing agent image from the image holding surface onto the transfer material, the intermediate transfer medium comprising:

an underlying layer; and a surface layer formed on the underlying layer and containing a compound having a polysilazane skeleton.

18. An apparatus according to claim 17, wherein the compound having a polysilazane skeleton further has an Si—O bond.

19. An apparatus according to claim 17, wherein the apparatus is a wet type electrophotographic apparatus.

20. An apparatus according to claim 17, wherein the apparatus is of a full color type.

* * * * *